US011566594B2

(12) United States Patent
Horikoshi et al.

(10) Patent No.: US 11,566,594 B2
(45) Date of Patent: Jan. 31, 2023

(54) ROPE REEL FOR RECOIL STARTER, AND RECOIL

(71) Applicant: STARTING INDUSTRIAL CO., LTD., Tokyo (JP)

(72) Inventors: Yoshinori Horikoshi, Tokyo (JP); Tomoyasu Mizuno, Tokyo (JP); Hideki Hashiba, Tokyo (JP)

(73) Assignee: STARTING INDUSTRIAL CO., LTD., Tokyo (JP)

( * ) Notice: Subject to any disclaimer, the term of this patent is extended or adjusted under 35 U.S.C. 154(b) by 0 days.

(21) Appl. No.: 17/424,863

(22) PCT Filed: Jan. 21, 2020

(86) PCT No.: PCT/JP2020/001995
§ 371 (c)(1),
(2) Date: Jul. 21, 2021

(87) PCT Pub. No.: WO2020/153379
PCT Pub. Date: Jul. 30, 2020

(65) Prior Publication Data

US 2022/0090570 A1 Mar. 24, 2022

(30) Foreign Application Priority Data

Jan. 22, 2019 (JP) ..... JP2019-008412

(51) Int. Cl.
*F02N 3/02* (2006.01)
*F02N 5/02* (2006.01)

(52) U.S. Cl.
CPC *F02N 3/02* (2013.01); *F02N 5/02* (2013.01)

(58) Field of Classification Search
CPC ..... F02N 3/02; F02N 5/02
(Continued)

(56) References Cited

U.S. PATENT DOCUMENTS 2,348,547 A 1/1941 Kissel
2,848,987 A 8/1958 Morden
(Continued)

FOREIGN PATENT DOCUMENTS

CN 103161635 A 6/2013
JP S54-048221 A 9/1952
(Continued)

OTHER PUBLICATIONS

International Search Report and Written Opinion for related PCT App No. PCT/JP2020/001995 dated Mar. 17, 2020, 9 pgs. (partial translation).

(Continued)

*Primary Examiner* — Logan M Kraft
*Assistant Examiner* — Arnold Castro
(74) *Attorney, Agent, or Firm* — Procopio, Cory, Hargreaves & Savitch LLP

(57) ABSTRACT

There is provided a rope reel provided in a recoil starter including: a rope holding groove; a flange portion disposed on both sides of the rope holding groove; a through hole provided in the flange portion and configured to allow an end of the rope wound around the rope holding groove to pass through; and an arch portion provided on a side surface of the rope reel and adjacent to the through hole. The arch portion is configured such that the rope is inserted therein, and the arch portion is capable of holding the inserted rope along the side surface of the rope reel. According to the above configuration, a front end portion of the rope is prevented from interfering with a rotation member at an engine side.

12 Claims, 7 Drawing Sheets

(58) Field of Classification Search
USPC ..... 123/185.3, 185.14
See application file for complete search history.

(56) References Cited

U.S. PATENT DOCUMENTS

| | | | | |
|---|---|---|---|---|
| 3,134,376 | A | 5/1964 | Rice | |
| 4,658,775 | A * | 4/1987 | Greenwood | F02B 63/02 123/185.3 |
| 4,841,929 | A * | 6/1989 | Tuggle | F01B 1/12 123/185.3 |
| 4,940,028 | A | 7/1990 | Tuggle | |
| 5,676,103 | A | 10/1997 | Tsunoda et al. | |
| 2003/0213455 | A1 * | 11/2003 | Tohyama | F02N 5/02 123/185.3 |
| 2004/0016311 | A1 * | 1/2004 | Hashiba | A01D 34/6818 74/8 |
| 2006/0219204 | A1 * | 10/2006 | Hashiba | F02N 3/02 123/185.3 |
| 2010/0162985 | A1 * | 7/2010 | Hashiba | F02N 3/02 123/185.3 |
| 2010/0170465 | A1 * | 7/2010 | Eakins, Jr. | F02N 3/02 123/185.3 |
| 2013/0152896 | A1 | 6/2013 | Matsui et al. | |

FOREIGN PATENT DOCUMENTS

| | | | |
|---|---|---|---|
| JP | 53117840 | A | 9/1978 |
| JP | S59-153971 | A | 9/1984 |
| JP | UM-S61-125668 | A | 8/1986 |
| JP | 2012251561 | A | 12/2012 |

OTHER PUBLICATIONS

State Intellectual Property Office of People's Republic of China, Notification of the First Office Action, Application No. CN 202080010838.2, dated May 30, 2022, in 16 pages.
European Patent Office, Extended European Search Report, Application No. 20745294.7, dated Sep. 13, 2022 in 7 pages.

* cited by examiner

ROPE REEL FOR RECOIL STARTER, AND RECOIL

CROSS-REFERENCE TO RELATED APPLICATIONS

This application is a U.S. National Stage entry of PCT Application No: PCT/JP2020/001995 filed Jan. 21, 2020, which claims priority to Japanese Patent Application No. 2019-008412 filed Jan. 22, 2019, the contents of which are incorporated herein by reference.

TECHNICAL FIELD

The present disclosure relates to a recoil starter capable of applying a starting rotational force to an engine by pulling a rope.

BACKGROUND ART

As a starting device for starting an engine, there is known a recoil starter in which a rope reel is rotated by pulling a rope wound around the rope reel, and the rotation of the rope reel is transmitted to a rotation member coupled to a crankshaft of an engine, and the crankshaft of the engine is rotated by the rotation member to start the engine.

An end of the rope wound around the rope reel is pulled out to an outside of a case so that one of ends of the rope can be pulled, and the other end of the rope is attached to the rope reel. For example, in a configuration described in JP2012-251561A, the end of the rope attached to the rope reel is locked to a side surface of the rope reel by forming a knot. The knot of the rope is not fixed to a side of a starter case covering the rope reel but to a side surface of the rope reel on an engine side. According to the above configuration, since there is no need to provide a gap for holding the knot of the rope between the rope reel and the starter case covering the rope reel, the starter case and the rope reel can be disposed as close as possible to each other. Therefore, a width of the recoil starter can be reduced as much as possible, and the recoil starter can be made compact.

However, in the configuration described in JP2012-251561A, since a portion of the rope on a front end side with respect to the knot is not fixed, a front end portion of the rope may interfere with the rotation member on the engine side.

As a method of preventing the interference, a method of sandwiching the front end portion of the rope near the knot can be considered. However, in the method of sandwiching the front end portion of the rope, the front end portion sandwiched near the knot may come off due to loosening of the rope.

As another method of preventing the interference, a method of fixing the front end portion of the rope by means of an adhesive or the like may be considered. However, if the front end portion of the rope is fixed by means of an adhesive or the like, there is a problem that the rope cannot be replaced.

SUMMARY OF INVENTION

The present disclosure is to provide a rope reel for a recoil starter in which a front end portion of a rope does not interfere with a rotation member on an engine side and the rope is easily replaced. Further, the present disclosure also relates to an end of a rope wound around the rope reel for a recoil starter.

Solution to Problem

According to an aspect of the present invention, a rope reel provided in a recoil starter includes a rope holding groove configured such that a rope is wound around the rope holding groove, a flange portion disposed on both sides of the rope holding groove, a through hole provided in the flange portion and configured to allow an end of the rope wound around the rope holding groove to pass through, and an arch portion provided on a side surface of the rope reel and adjacent to the through hole. The arch portion is configured such that the rope is inserted in the arch portion, and the arch portion is capable of holding the inserted rope along the side surface of the rope reel.

According to the above aspect of the present invention, the rope reel for a recoil starter includes the through hole provided in the flange portion so as to allow the end of the rope wound around the rope holding groove to pass therethrough, and the arch portion provided on the side surface of the rope reel and adjacent to the through hole, and the rope can be inserted through the arch portion and the arch portion can hold the inserted rope along the side surface of the rope reel. According to the above configuration, since a front end portion of the rope can be firmly fixed by being inserted into the arch portion, the front end portion of the rope does not interfere with a rotation member at an engine side. Further, since the front end portion of the rope is held along the side surface of the rope reel, the rope reel can be disposed close to the rotation member, and the degree of freedom in layout can be increased. For example, a width of the recoil starter can be reduced and the recoil starter can be reduced in size. Further, since the rope can be removed simply by pulling out the rope from the arch portion, the rope can be easily replaced.

DESCRIPTION OF EMBODIMENTS

Embodiments of the present invention will be described with reference to the drawings.

Figure 1:
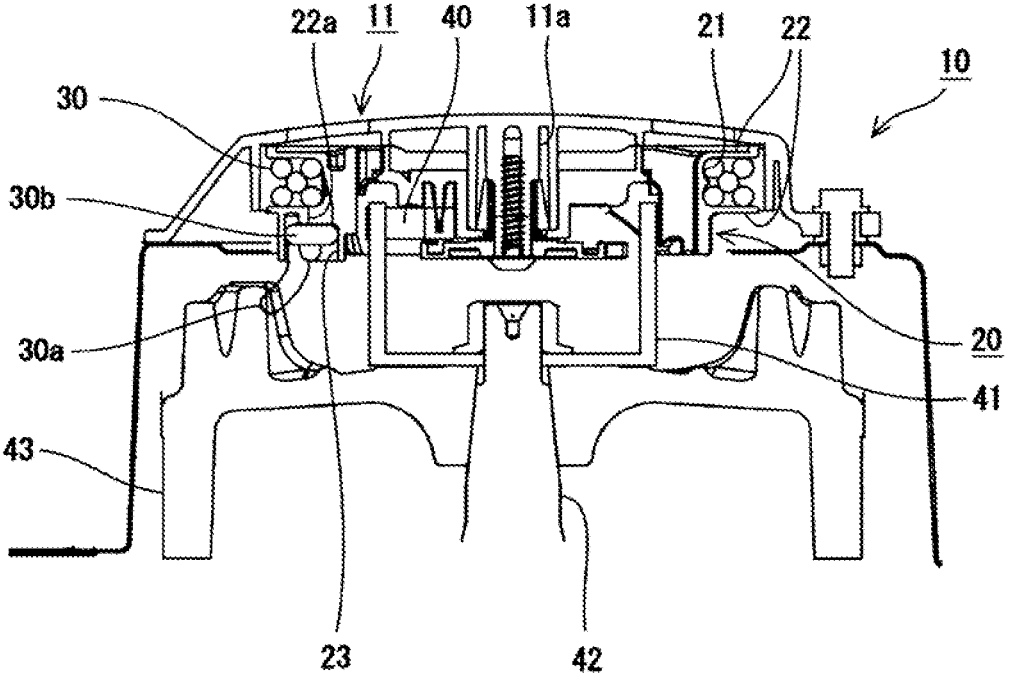
FIG. 1 is a cross-sectional view showing a recoil starter in a state in which an end of a rope is not held.

A recoil starter 10 according to the present embodiment starts an engine by applying a rotational force to an engine crankshaft 42. As shown in FIG. 1, the recoil starter 10 includes a starter case 11, a rope reel 20, a ratchet member 40, a drive pulley 41, and the like.

The starter case 11 is disposed so as to cover a side surface portion of the engine while accommodating main components of the recoil starter 10. At a center of the starter case 11, a reel support shaft 11*a* protruding inward so as to face the engine crankshaft 42 is provided. The rope reel 20 to be described later is rotatably attached to the reel support shaft 11*a*.

The rope reel 20 is a wheel-shaped member, and includes a rope holding groove 21 configured such that a rope 30 is wound around the rope reel 20. The reel support shaft 11*a* passes through a hole formed in a central portion of the rope reel 20, and thus the rope reel 20 is rotatably attached to the reel support shaft 11*a*. One end of the rope 30 wound around the rope reel 20 is fixed to the rope reel 20, and the other end of the rope 30 is drawn out to an outside of the starter case 11. Therefore, the rope reel 20 is configured to rotate around the reel support shaft 11*a* by an operator vigorously pulling the drawn out rope 30.

When the operator releases the drawn out rope 30, the rope reel 20 is reversely rotated by a return spring, and the rope 30 is automatically wound up. The return spring is a spiral spring, and one end of the return spring is fixed to the starter case 11 and the other end is fixed to the rope reel 20. When the rope reel 20 rotates by pulling out the rope 30, a rotational force is accumulated in the return spring. Further, when the pulled rope 30 is released, the rope reel 20 is reversely rotated due to the spring force accumulated in the return spring, and the rope reel 20 winds up the rope 30.

The ratchet member 40 is attached to the rope reel 20 so as to rotate integrally with the rope reel 20. The ratchet member 40 is swingably attached to a side surface of the rope reel 20, and the ratchet member 40 is formed so as to engage with an inner peripheral surface of a drive pulley 41 to be described later, by swinging the ratchet member 40. Since a structure in the related art may be applied to the ratchet member 40, although a configuration of the ratchet member 40 is not described in detail, the ratchet member 40 is configured to engage with the drive pulley 41 only when the rope reel 20 attempts to rotate in a predetermined direction (a direction in which the engine is started) with respect to the drive pulley 41.

That is, when the rope reel 20 is rotated by performing an operation of pulling out the rope 30, the ratchet member 40 swings to engage with the drive pulley 41, and the rotational force of the rope reel 20 is transmitted to the drive pulley 41. Meanwhile, when the rope reel 20 is rotating in a winding direction of the rope 30 or when the rope reel 20 is not rotating, the ratchet member 40 swings in a retracting direction and does not engage with the drive pulley 41. As a result, the rope reel 20 and the drive pulley 41 do not transmit rotational force to each other.

The drive pulley 41 is a tubular member and is connected to the engine crankshaft 42. The drive pulley 41 is rotatably supported coaxially with the rotation shaft (reel support shaft 11*a*) of the rope reel 20. When the rotational force of the rope reel 20 is transmitted to the drive pulley 41 and the drive pulley 41 starts to rotate, the engine crankshaft 42 integrally coupled to the drive pulley 41 rotates, and a starting rotational force is applied to the engine.

In addition to the drive pulley 41, a rotation member 43 that rotates integrally with the engine crankshaft 42 is attached to the engine crankshaft 42 according to the present embodiment. For example, a rotation member 43 having a fan shape for blowing air to the engine is attached.

In the recoil starter 10 described above, an end of the rope 30 attached to the rope reel 20 is locked to a side surface of the rope reel 20 by forming a knot 30*b*. As shown in FIG. 1, the knot 30*b* of the rope 30 is fixed to a side surface of the rope reel 20 disposed on an engine side. According to the above configuration, there is no need to provide a gap for holding the knot 30*b* of the rope 30 between the starter case 11 covering the rope reel 20 and the rope reel 20, so that the starter case 11 and the rope reel 20 can be disposed as close as possible to each other. Therefore, a width of the recoil starter 10 can be reduced as much as possible.

However, as shown in FIG. 1, if a portion of the rope 30 on the front end side with respect to the knot 30*b* is not fixed, a front end portion 30*a* of the rope 30 may interfere with the rotation member 43 on the engine side. In this regard, the rope reel 20 according to the present embodiment can hold the end of the rope 30, and is formed so as to prevent interference between the rotation member 43 and the front end portion 30*a* of the rope 30.

Figure 2A:
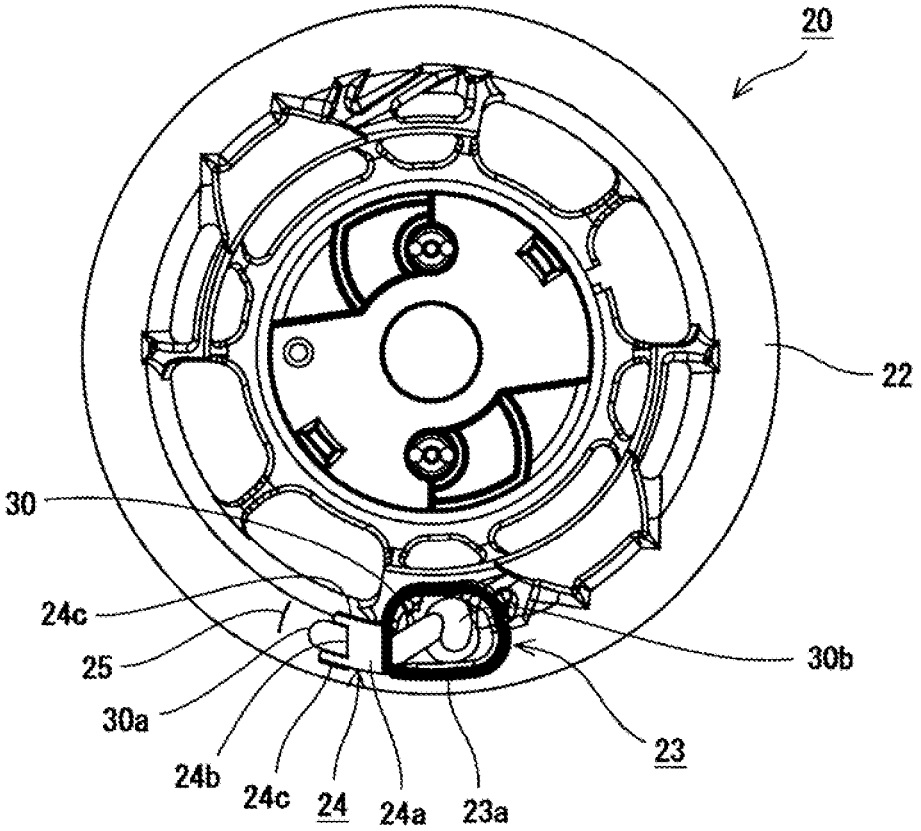
FIG. 2A is a side view showing a rope reel to which a rope is attached.
Figure 2B:
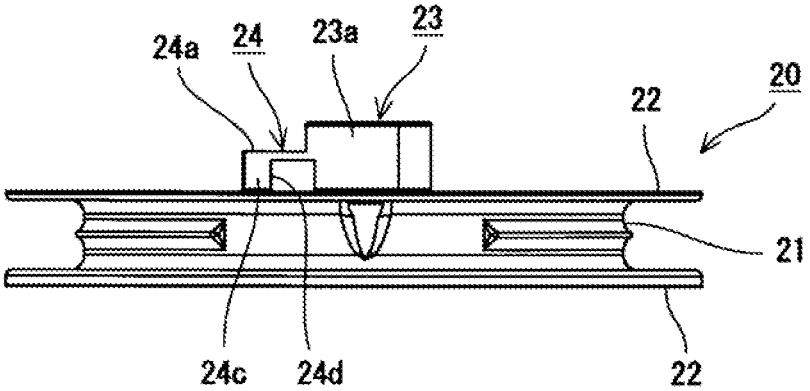
FIG. 2B is a front view showing the rope reel.

That is, as shown in FIGS. 2A and 2B, the rope reel 20 according to the present embodiment includes flange portions 22 disposed on both sides of the rope holding groove 21, an end accommodating portion 23 provided on the side surface of the rope reel 20, and an arch portion 24 provided on the side surface of the rope reel 20 adjacent to the end accommodating portion 23.

Figure 4:
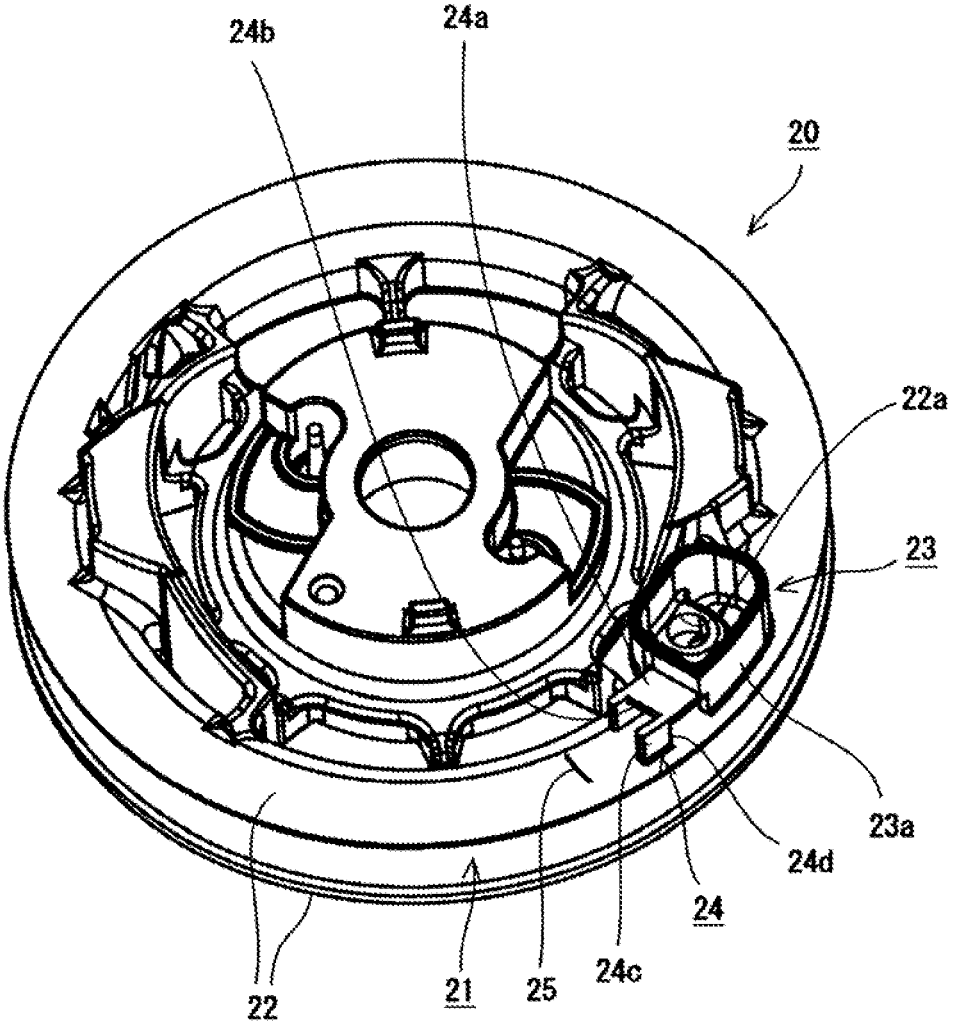
FIG. 4 is a perspective view showing the rope reel.
Figure 5:
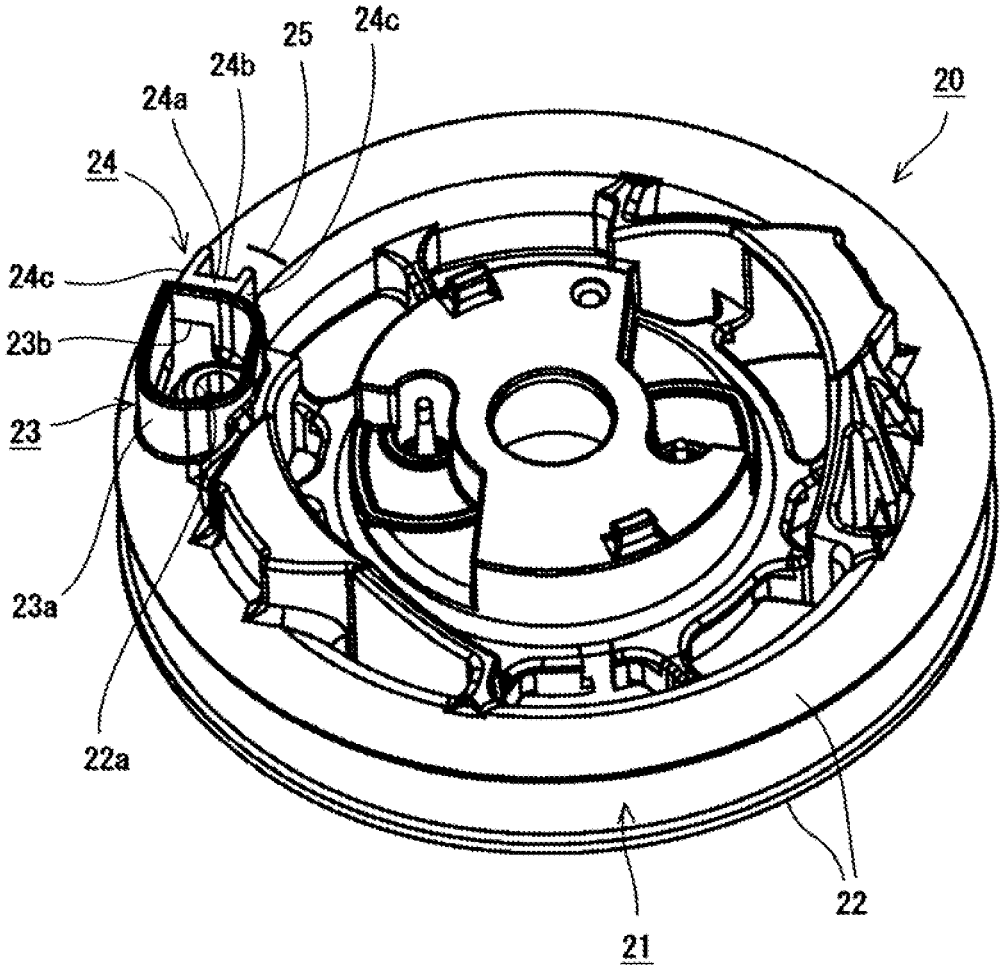
FIG. 5 is a perspective view of the rope reel as viewed from another angle.

The flange portions 22 are formed in a pair so as to face each other, and the rope holding groove 21 is formed between the pair of flange portions 22. As shown in FIGS. 4 and 5, the flange portion 22 disposed on the engine side in the pair of flange portions 22 is provided with a through hole 22*a* configured to allow an end of the rope 30 wound around the rope holding groove 21 to pass therethrough.

The end accommodating portion 23 is configured to accommodate the knot 30*b* of the rope 30, and is formed by walls 23*a* surrounding a periphery of the through hole 22*a*. The end accommodating portion 23 is surrounded by the walls 23*a* provided so as to protrude from one side of the rope reel 20 in an axial direction of the rope reel 20. Further, since front end portions of the walls 23*a* are not covered, as shown in FIG. 2A, the knot 30*b* of the rope 30 is exposed on the side surface of the rope reel 20.

As shown in FIG. 5, an insertion hole 23*b* is formed in the wall 23*a* of the end accommodating portion 23. The insertion hole 23*b* is formed in at least one of the walls 23*a* forming the end accommodating portion 23. In the present embodiment, when viewed from the through hole 22*a*, the insertion hole 23*b* is formed in the wall 23*a* disposed in a peripheral direction. The insertion hole 23*b* establishes communication between the end accommodating portion 23 and the arch portion 24. In other words, the insertion hole 23*b* is configured such that the rope 30 is guided to the arch portion 24 by inserting the rope 30 into the insertion hole 23*b* from the end accommodating portion 23.

The arch portion 24 is configured to hold a portion of the rope 30 on the front end side with respect to the knot 30*b*. An annular insertion path through which the rope 30 can be inserted is formed in the arch portion 24, and the arch portion 24 can hold the interested rope 30 along the side surface of the rope reel 20. The arch portion 24 according to the present embodiment is formed continuously with the insertion hole 23*b* formed in the wall 23*a* of the end accommodating portion 23. In other words, the end accommodating portion 23 is provided on one side and the arch portion 24 is provided on the other side across the wall 23*a* in which the insertion hole 23*b* is formed.

The arch portion 24 is disposed adjacent to the end accommodating portion 23 along a peripheral direction of the flange portion 22. Therefore, as shown in FIG. 2A, the end of the rope 30 held by the arch portion 24 is also held along the peripheral direction of the flange portion 22.

The arch portion 24 according to the present embodiment includes a pair of side walls 24*c* erected perpendicularly to the side surface of the rope reel 20, and an upper wall 24*a* connecting upper end portions of the pair of side walls 24*c*. More specifically, a substantially U-shaped arch portion 24 is formed by the pair of side walls 24*c* and the upper wall 24*a*. A width of the arch portion 24 (a width of the pair of side walls 24*c* and a width between the side surface of the rope reel 20 and the upper wall 24*a*) is designed to be slightly larger than a diameter of the rope 30 in order to facilitate insertion of the front end portion 30*a* of the rope 30.

For example, as shown in FIG. 4, the upper wall 24*a* is provided with a notch 24*b* at an end portion far from the through hole 22*a* (or the end accommodating portion 23) (in other words, the upper wall 24*a* is provided with a notch 24*b* at a side where the rope 30 is guided out from the arch portion 24). By providing the notch 24*b*, when the front end portion 30*a* of the rope 30 passes through the arch portion 24, the front end portion 30*a* is easily pulled out from the notch 24*b*.

Figure 3:
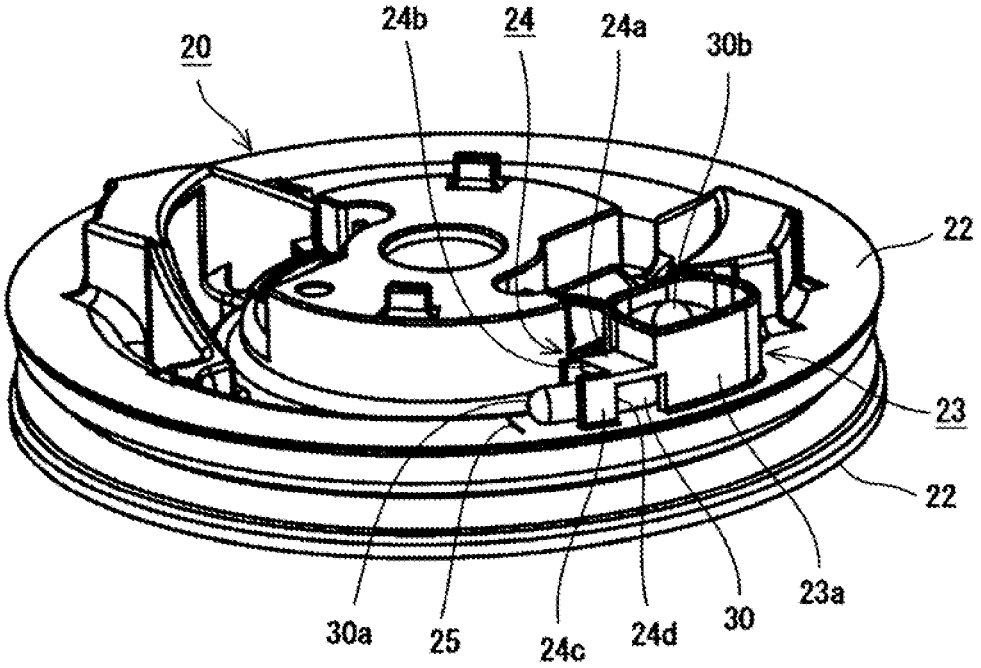
FIG. 3 is a perspective view showing the rope reel to which the rope is attached.

Further, for example, as shown in FIG. 3, an opening 24*d* for exposing the rope 30 is formed in the side wall 24*c*. By providing the opening 24*d*, when the front end portion 30*a* of the rope 30 passes through the arch portion 24, the rope 30 can be operated from the opening 24*d*, and the rope 30 can easily passes through.

In the present embodiment, a scale 25 on which a position of the front end portion 30*a* of the rope 30 passing through the arch portion 24 is confirmed is provided on the side surface of the rope reel 20. The scale 25 is formed on an extension line of the arch portion 24 (at a position away from the arch portion 24) along the peripheral direction of the flange portion 22 at a predetermined interval from the arch portion 24. The scale 25 is displayed on a side surface of the rope reel 20 by a method in the related art such as engraving, molding, printing, or the like. When the rope 30 is attached to the rope reel 20, for example, as shown in FIG. 2A, a position of the knot 30*b* is adjusted such that the front end portion 30*a* of the rope 30 has a length that does not exceed the scale 25. By attaching the rope 30 in this manner, the front end portion 30*a* of the rope 30 that is not held by the arch portion 24 can be prevented from becoming too long, and thus the front end portion 30*a* of the rope 30 can be prevented from interfering with a member on the engine side.

As described above, according to the present embodiment, in order to pass the end of the rope 30 wound around the rope holding groove 21, the through hole 22*a* provided in the flange portion 22 and the arch portion 24 provided on the side surface of the rope reel 20 adjacent to the through hole 22*a* are provided, the rope 30 can be inserted through the arch portion 24 and the inserted rope 30 can be held along the side surface of the rope reel 20. Therefore, since the front end portion 30*a* of the rope 30 can be firmly fixed by being inserted into the arch portion 24, the front end portion 30*a* of the rope 30 does not interfere with the rotation member 43 on the engine side. Further, since the front end portion 30*a* of the rope 30 is held along the side surface of the rope reel 20, the rope reel 20 can be disposed close to the rotation member 43, and the degree of freedom in layout can be increased. For example, the width of the recoil starter 10 can be reduced and the recoil starter 10 can be reduced in size. Further, since the rope 30 can be removed simply by pulling out the rope 30 from the arch portion 24, the rope 30 can be easily replaced.

Further, the walls 23*a* are formed so as to surround the periphery of the through hole 22*a* to form the end accommodating portion 23 for accommodating the knot 30*b* of the rope 30, and the arch portion 24 is formed continuously with the insertion hole 23*b* formed in the wall 23*a* of the end accommodating portion 23. According to such a configuration, since the knot 30*b* of the rope 30 may be formed with reference to a height of the wall 23*a* of the end accommodating portion 23, the rope 30 can be easily attached. Further, the rope 30 is held by the arch portion 24 simply by inserting the end of the rope 30 on the front end side with respect to the knot 30*b* into the insertion hole 23*b* formed in the wall 23*a* of the end accommodating portion 23, the rope 30 can be prevented from interfering with the rotation member 43 on the engine side.

Further, the opening 24*d* for exposing the rope 30 is formed in the side surface of the arch portion 24. Therefore, since the rope 30 can be operated from the opening 24*d* when the rope 30 is inserted or removed, the work of attaching or detaching the rope 30 can be easily performed.

Further, the side surface of the rope reel 20 is provided with the scale 25 for checking the position of the front end portion 30*a* of the rope 30 passing through the arch portion 24. According to such a configuration, since the length of the end of the rope 30 can be managed by the scale 25, the rope 30 can be attached so as not to interfere with the rotation member 43 on the engine side.

Further, since the arch portion 24 is formed integrally with the rope reel 20 and is not a separate component, an increase in cost due to providing a separate component can be avoided.

A shape of the arch portion 24 is not limited to the shape described in the above embodiment, and various shapes can be considered.

Figure 6:
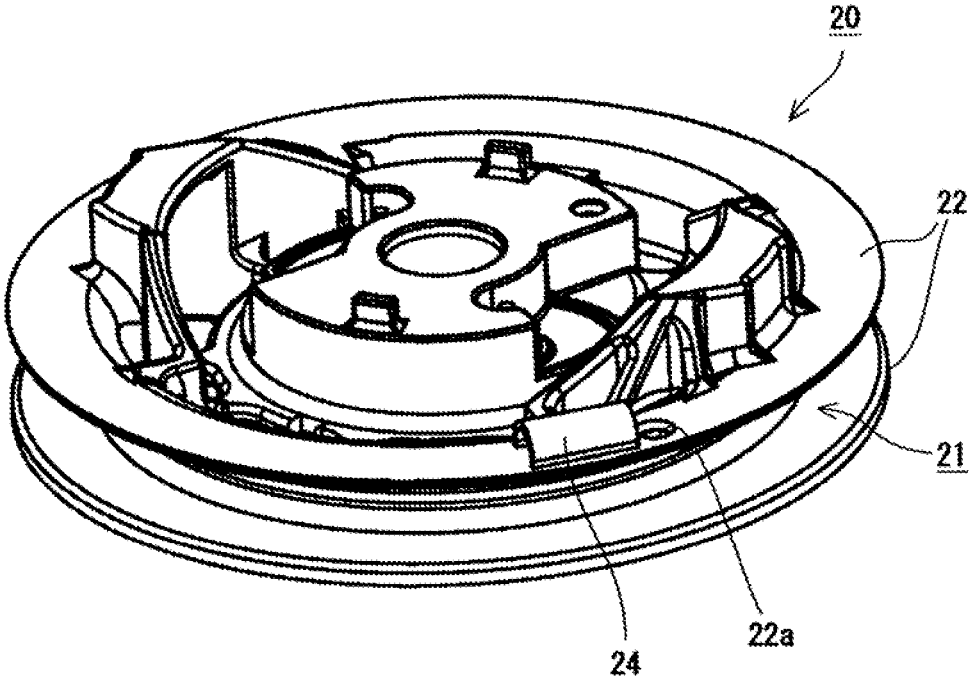
FIG. 6 is a perspective view showing a rope reel according to a first modification.

For example, as shown in FIG. 6, a semi-cylindrical arch portion 24 may be formed. In the example shown in FIG. 6, the end accommodating portion 23 is omitted, and the end accommodating portion 23 may have a simple shape by omitting it.

Figure 7A:
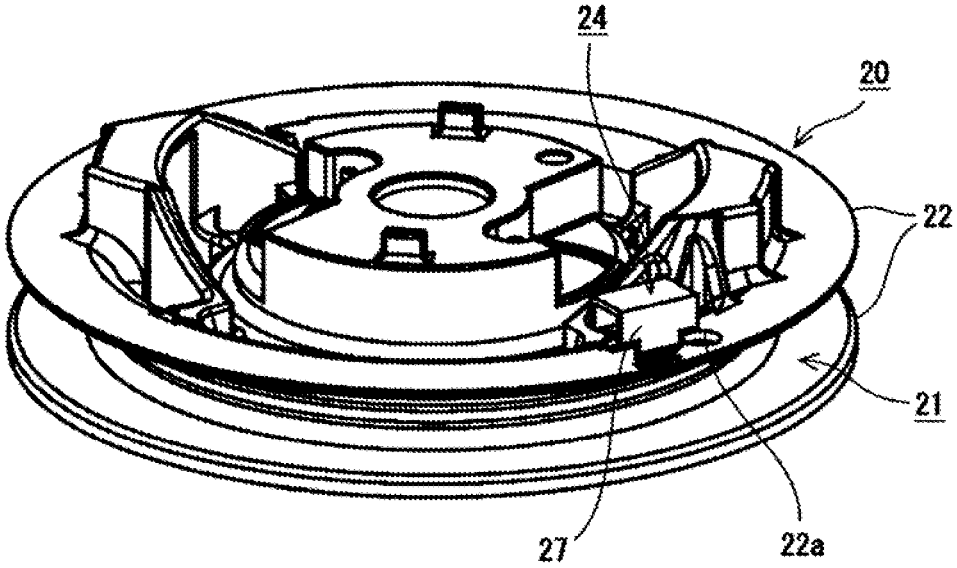
FIG. 7A is a perspective view showing a rope reel according to a second modification.
Figure 7B:
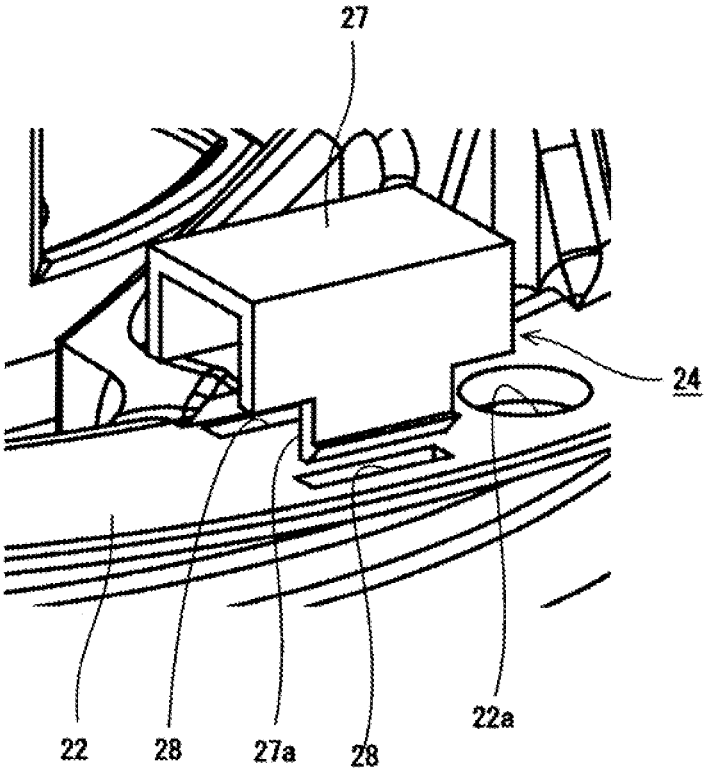
FIG. 7B is a partially enlarged perspective view showing the rope reel according to the second modification.

As shown in FIGS. 7A and 7B, the arch portion 24 may be formed by a holding member 27 that is detachable with respect to the side surface of the rope reel 20. For example, a locking claw 27*a* having a barb shape may be provided at a front end of the holding member 27, and an attachment hole 28 that can be engaged with the locking claw 27*a* may be provided in the side surface of the rope reel 20. Then, the holding member 27 may be attached to the side surface of the rope reel 20 by engaging the locking claw 27*a* with the attachment hole 28, and the arch portion 24 that is annularly closed may be formed on the side surface of the rope reel 20 by attaching the holding member 27.

If the arch portion 24 is formed by the detachable holding member 27 in this way, the end of the rope 30 can be pressed later, and thus the assemblability is improved. Further, in such a configuration, since there is no need to consider the ease of insertion of the rope 30 into the arch portion 24, the width of the arch portion 24 does not need to be larger than the diameter of the rope 30. Therefore, the width of the arch portion 24 can be set so as to press the rope 30, and a holding force of the rope 30 can be increased.

The present application is based on Japanese Patent Application No. 2019-008412 filed on Jan. 22, 2019, the contents of which are incorporated herein by reference.

The invention claimed is:

1. A rope reel provided on a recoil starter, comprising:

a rope holding groove configured such that a rope is wound around the rope holding groove, a flange portion disposed on both sides of the rope holding groove;

a through hole provided in the flange portion and configured to allow an end of the rope wound around the rope holding groove to pass through from a side surface of the rope reel on an engine side; and an arch portion provided to protrude from the side surface of the rope reel and adjacent to the through hole, wherein the end of the rope is locked to the side surface of the rope reel by forming a knot, wherein the arch portion is configured to hold a portion of the rope on a front end side with respect to the knot, wherein the arch portion includes an annular insertion path through which the rope is insertable, and the arch portion is capable of holding the inserted rope along the side surface of the rope reel, and wherein the annular insertion path includes an insertion hole that directly receives the end of the rope that passes from the through hole.

2. The rope reel according to claim 1, further comprising:

an end accommodating portion configured to accommodate the knot of the rope, wherein the end accommodating portion includes a wall formed to surround a periphery of the through hole, and the arch portion is formed adjacently to an insertion hole formed in the wall.

3. The rope reel according to claim 1, wherein the arch portion includes an opening that exposes the rope at the side surface of the rope reel.

4. The rope reel according to claim 3, wherein the opening of the arch portion is formed in a side surface of the arch portion.

5. The rope reel according to claim 1, wherein the rope is configured to pass through the arch portion, and wherein a scale is provided on the side surface of the rope reel so as to confirm a position of a front end portion of the rope.

6. A recoil starter comprising:

the rope reel according to claim 1, wherein the arch portion is disposed at an engine side.

7. A rope reel provided on a recoil starter, comprising:

a rope holding groove configured such that a rope is wound around the rope holding groove;

a flange portion disposed on both sides of the rope holding groove;

a through hole provided in the flange portion and configured to allow an end of the rope wound around the rope holding groove to pass through; and an arch portion provided on a side surface of the rope reel and adjacent to the through hole, wherein the end of the rope is locked to the side surface of the rope reel by forming a knot, wherein the arch portion is configured to hold a portion of the rope on a front end side with respect to the knot, wherein the arch portion includes an annular insertion path through which the rope is insertable, and the arch portion is capable of holding the inserted rope along the side surface of the rope reel, wherein the annular insertion path includes an insertion hole that directly receives the end of the rope that passes from the through hole, and wherein the arch portion is a detachable holding member provided on the side surface of the rope reel.

8. A rope reel provided on a recoil starter, comprising:

a rope holding groove configured such that a rope is wound around the rope holding groove;

a flange portion disposed on both sides of the rope holding groove;

a through hole provided in the flange portion and configured to allow an end of the rope wound around the rope holding groove to pass through; and an arch portion provided on a side surface of the rope reel and adjacent to the through hole, wherein the end of the rope is locked to the side surface of the rope reel by forming a knot, wherein the arch portion is configured to hold a portion of the rope on a front end side with respect to the knot, wherein the arch portion includes an annular insertion path through which the rope is insertable, and the arch portion is capable of holding the inserted rope along the side surface of the rope reel, wherein the annular insertion path includes an insertion hole that directly receives the end of the rope that passes from the through hole, and wherein the arch portion includes:

a pair of side walls erected perpendicularly to the side surface of the rope reel; and an upper wall connecting upper end portions of the pair of side walls.

9. The rope reel according to claim 8, wherein the rope passes below the upper wall of the arch portion.

10. The rope reel according to claim 8, wherein the insertion hole is located below the upper wall of the arch portion and between the side walls of the arch portion.

11. The rope reel according to claim 8, wherein, as viewed from an axial direction of the rope reel, the upper wall of the arch portion completely covers the rope.

12. The rope reel according to claim 8, wherein, as viewed from an axial direction of the rope reel, the arch portion completely covers the rope.

* * * * *